United States Patent [19]

Vinals et al.

[11] 3,977,418

[45] Aug. 31, 1976

[54] TOBACCO ARTICLE COMPRISING THE FLAVORING COMPOSITION TRICYCLENE-9-BUTENONE AND THE PROCESS FOR MAKING THE SAME

[75] Inventors: Joaquin Francisco Vinals, Red Bank; Manfred Hugo Vock, Locust; Braja Dulal Mookherjee, Matawan; Venkatesh Kamath, Red Bank, all of N.J.

[73] Assignee: International Flavors & Fragrances Inc., New York, N.Y.

[22] Filed: Mar. 10, 1975

[21] Appl. No.: 556,873

[52] U.S. Cl. ..... 131/17 R; 131/144

[51] Int. Cl.[2] ..... A24B 3/12

[58] Field of Search ..... 131/17 R, 2, 140–144

[56] References Cited

OTHER PUBLICATIONS

"Dangerous Properties of Industrial Materials" by Sax, 3rd Edition; Reinhold Book Corp., 1964, p. 1069.

*Primary Examiner*—Robert W. Michell
*Assistant Examiner*—V. Millin
*Attorney, Agent, or Firm*—Arthur L. Liberman; Harold Haidt

[57] ABSTRACT

Described is a process comprising adding to homogenized or reconstituted tobacco (for subsequent incorporation into smoking articles along with tobacco blend) an amount sufficient to alter the flavor or aroma of the ultimate tobacco mixture of tricyclene-9-butenone (1,7-dimethyl-7(1-pent-2-en-4-onyl) nortricyclene) having the structure:

3 Claims, 2 Drawing Figures

EXAMPLE I, 1,7-dimethyl-7 (1-pent-2-en-4-onyl) nortricyclene

FIG. 1
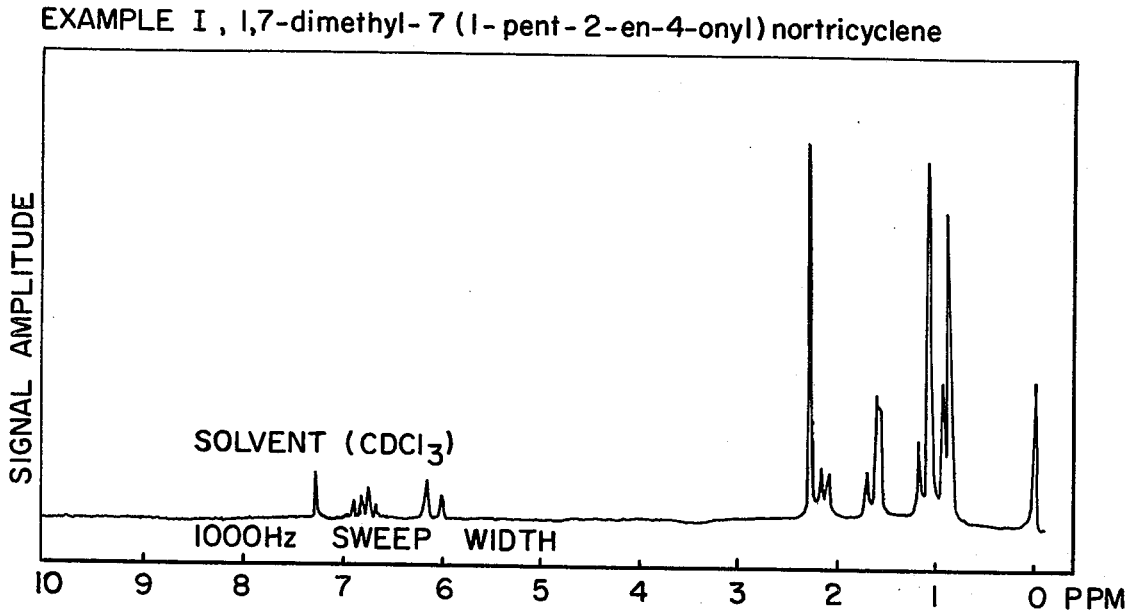
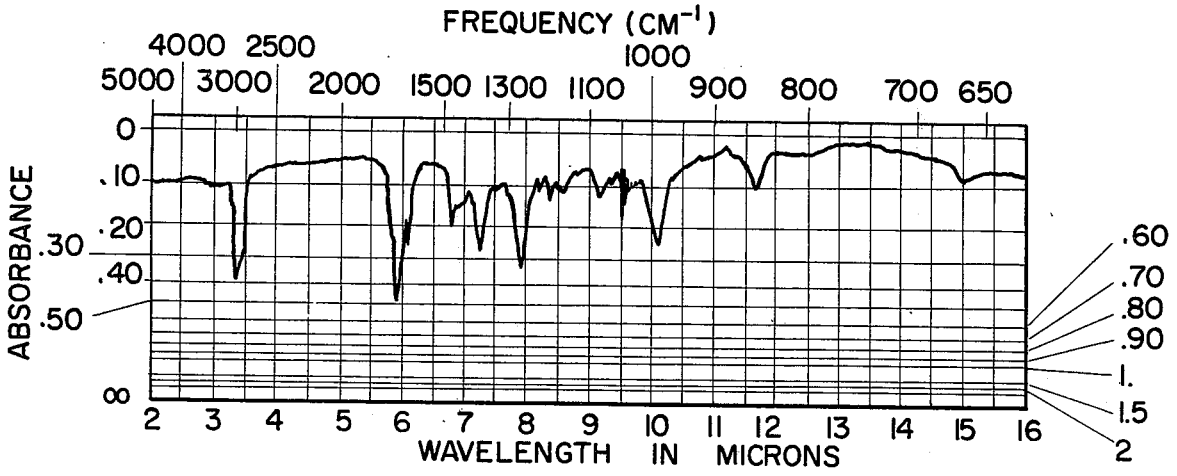
EXAMPLE I, 1,7-dimethyl-7 (1-pent-2-en-4-onyl) nortricyclene
FIG. 2

TOBACCO ARTICLE COMPRISING THE FLAVORING COMPOSITION TRICYCLENE-9-BUTENONE AND THE PROCESS FOR MAKING THE SAME

BACKGROUND OF THE INVENTION

This invention relates to novel tobacco products, novel tobacco flavoring compositions, and processes for producing same, and has for an object the provision of a composition and process for improving the flavor and aroma of tobacco and tobacco smoke and, at the same time, reducing the tar and nicotine delivery of a smoking article.

It is well known in the tobacco art that the flavor and aroma of the tobacco product and the smoke from the tobacco are very important considerations insofar as the ultimate consumer is concerned. Considerable efforts have been and are being exerted by the manufacturers of tobacco products to provide a product that will be both acceptable to the consumer, particularly as regards flavor and aroma characteristics and reduction of tar and nicotine delivery on smoking. Homogenized (or reconstituted) tobacco has been used by the tobacco industry in the manufacture of smoking articles having reduced tar and nicotine delivery on smoking. It has been a goal in the tobacco industry to prepare blends of domestic tobaccos, oriental tobaccos and "homogenized tobacco" (which is usually a blend of burley and/or bright tobacco stems, dust and/or scrap) in order to provide smoking tobacco which has a pleasing flavor and aroma before and during smoking. However, notwithstanding that "homogenized tobacco" is used in conjunction with the more expensive tobaccos, such a procedure is costly and may at times become prohibitive in the event that certain types of tobacco may be in short supply. Accordingly, there has been considerable work relating to substances which can be used to impart flavors to various tobacco blends which include the aforementioned "homogenized tobacco". These substances are used to supplement natural materials some of which, as stated above, may be in short supply, and to provide more uniform properties to the finished product. Use of unflavored homogenized tobacco has been found to detract from the organoleptic properties of regular tobacco blends.

Sweet, floral, spicy and woody notes are particularly desirable for many uses concerning the flavoring of tobacco products; both prior to and on smoking.

Arctander, Perfume and Flavor Chemicals (Aroma Chemicals) 1969 discloses at Vol. II, NO. 2819 that alpha-stantalol, having the structure:

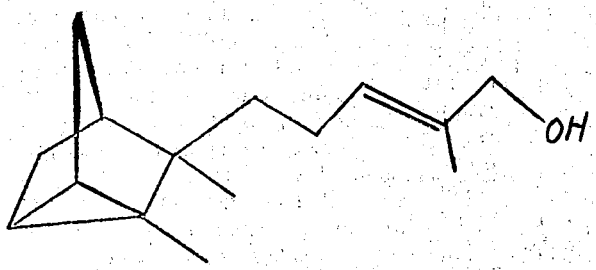

is "used in flavor compositions, in trace amounts in various floral and fruity complexes. The concentration will rarely exceed 10 ppm in the finished product. Santalol shows less tendency of 'standing out' of a flavor than does Sandalwood oil. It is, . . . , much easier to use Santalol in a flavor than it is to use Sandalwood Oil."

Firmenich et al. British Patent No. 1,240,309 published on July 21, 1971, describes an improved tobacco product containing ketones having the formula:

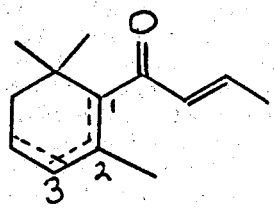

wherein at least one of the dashed lines represents a double bond and which compound contains one double bond in one of the positions 1 and 2 or two double bonds in positions 1 and 3. The disclosure of the use of these compounds in tobacco products is set forth on page 1, line 35.

Similarly, German Offenlegungsschrift 2,353,468 published on May 9, 1974 describes compounds having the structure:

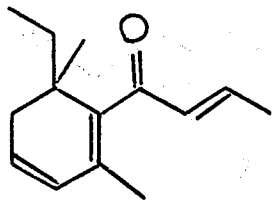

as being useful as tobacco flavorants.

The use of Diels-Alder adducts as tobacco additives which "improve the aroma and flavor characteristics of the tobacco" and which additives include tricyclic ketones is disclosed by Bavley et al. in U.S. Pat. No. 3,047,433 issued on July 31, 1962.

U.S. Pat. No. 3,268,589 issued on Aug. 23, 1966 discloses a technique for enhancing the flavor of tobacco by adding thereto a small amount of 4-(2-butenylidene)-3,5,5-trimenthyl-2-cyclohexene-1-on having the structure:

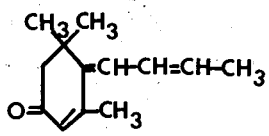

Cigarettes treated using the above compound are indicated in U.S. Pat. NO. 3,268,589 to have "desired and pleasing peppery and spicy odor which detectible to some extent when the cigarette is in its package, but which is particularly detectible and pleasing in the main and side smoke streams when the cigarette is smoked."

In accordance with U.S. Pat. No. 3,828,795 issued on Aug. 13, 1974, the flavor and/or aroma of tobacco or tobacco products is improved by adding thereto a small amount of a compound having the following general formula:

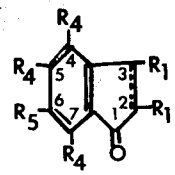

wherein each of the R groups is hydrogen or alkyl of one to four carbon atoms and wherein a double bond may be present between the $C_2$ and $C_3$ carbon atoms as indicated by the broken line.

However, compounds having the structure of the tricyclene-9-butenone of the instant invention have never been described in the literature; and the imparting to smoking articles in the main and side stream of sweet, floral, spicy and woody notes by incorporating such compounds into homogenized tobacco prior to further incorporation with blended tobacco into smoking articles has never been disclosed.

It has now been discovered that tobacco products having floral, spicy and woody flavors and aromas on smoking as well as lowered tar and nicotine delivery may be provided by adding to homogenized tobacco and/or to homogenized tobacco sheets tricyclene-9-butenone (which may also be named 1,7-dimethyl-7 (1-pent-2-en-4-onyl) nortricyclene) having the structure:

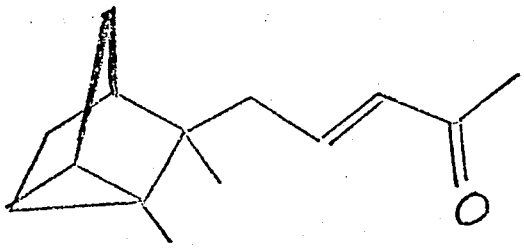

One of the processes capable of yielding tricyclene-9-butenone comprises the steps of:

i. Reacting a $\pi$-halotricyclene having the structure:

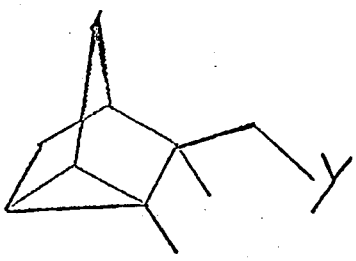

with an alkali metal cyanide in the presence of an inert solvent thereby forming a nitrile having the structure:

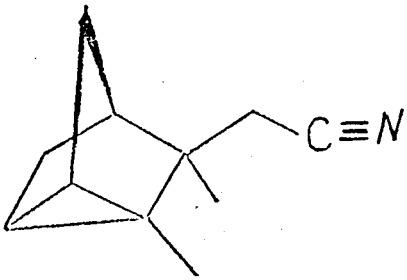

ii. Reacting the thus formed nitrile with diisobutyl aluminum hydride thus forming a nortricycloekasantalal having the structure:

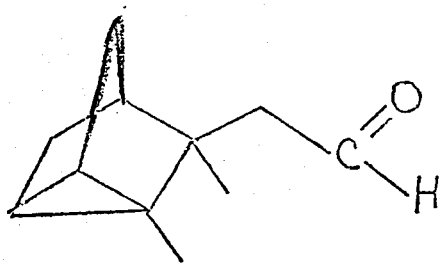

iii. Reacting the thus formed nortricycloekasantalal with acetone in the presence of a base selected from the group consisting of alkali metal hydroxides and alkaline earth metal hydroxides thus forming the tricyclene-9-butenone wherein Y is halogen selected from the group consisting of bromo, chloro and iodo.

The preparation of $\pi$-cyanotricyclene is carried out by reacting an alkali metal cyanide with a $\pi$-halo tricyclene having the generic structure:

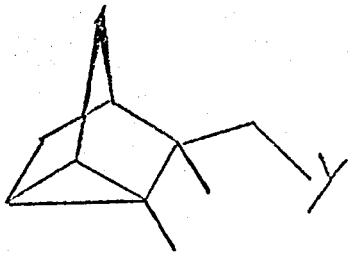

wherein Y is a halogen selected from the group consisting of chloro, bromo and iodo. Examples of alkali metal cyanide useful in the reaction are sodium cyanide and potassium cyanide. The reaction is carried out in an inert solvent such as dimethyl sulfoxide at a temperature in the range of from 80°C up to 100°C; preferably 90°C. The mole ratio of alkali metal cyanide to $\pi$-halo tricyclene is from 10:1 up to 20:1 with a mole ratio of 15:1 being preferred.

The formation of nortricycloekasantalal is carried out by means of reduction of $\pi$-cyanotricyclene using such reducing reagents as diisobutyl aluminum hydride preferably premixed with inert solvent such as hexane. The reaction is carried out in an inert solvent such as hexane or cyclohexane in order to facilitate control of the reaction. The reaction temperature is preferably in the range of from about 40°C up to 80°C with a temperature of about 55°C being preferred. The mole ratio of reduction reagent: $\pi$-cyanotricyclene is about 1:1 with the reduction reagent being in slight excess.

The tricyclene-9-butenone is prepared by reacting the nortricycloekasantalal with acetone. The reaction in a standard "Aldol Condensation" type reaction which is carried out in the presence of a base which is either an alkali metal hydroxide such as lithium hydroxide, sodium hydroxide or potassium hydroxide or an alkaline earth metal hydroxide such as barium hydroxide or calcium hydroxide. A type of apparatus useful for carrying out the reaction when using an alkaline earth metal hydroxide is a "Soxhlet" apparatus; since the alkaline earth metal hydroxide is only very slightly soluble in the reaction medium.

The temperature of Aldol condensation reaction is preferably in the range of from 25°C up to 50°C with a temperature of about 35°C being preferred. The mole ratio of acetone:nortricycloekasantalal is preferably in the range of from 5:1 up to 15:1 with a ratio of about 7:1 being preferred. The quantity of base used in the reaction is preferably about 10% of the weight of ketone used; but quantities of base which are as low as 5% of the weight of ketone or as high as 20% of the weight of ketone may be used without creating an adverse effect on the yield of product. Quantities of base lower than 5% by weight of ketone will cause the time of reaction to be unduly lengthened. Quantities of base in excess of 20% will not have any beneficial effect on rate of reaction or yield of product; and will cause an excessive amount of by-products to be formed.

It has been found that the tricyclene-9-butenone of our invention when incorporated into homogenized tobacco sheet (which, in turn, is ordinarily admixed with standard tobacco prior to the manufacture thereof into smoking articles, e.g., cigarettes and cigars) imparts a flavor and aroma both before and during smoking which many smokers consider to be desirable in smoking products. However, it is pointed out that the methods for defining or characterizing the quality of a flavor or aroma in the tobacco art are almost purely subjective and different smokers may define the same flavor quite differently. Thus, the tricyclene-9-butenone of this invention, by subjective tests, imparts a characteristic flavor which is desirable in tobacco products and the smoke therefrom even though the precise character thereof cannot be described on the basis of known standards.

In accordance with this invention, the tricyclene-9-butenone of our invention is added to homogenized tobacco in amount of about 100–5000 parts per million (ppm) based on dry weight of the final smoking article into which said homogenized tobacco is incorporated. Preferably, the amount of additive is between about 150 and 400 ppm by weight in order to provide an ultimate tobacco product having a desired flavor and aroma. However, the amount used will depend upon the amount of flavor and aroma desired and the particular compound or mixture thereof that is used.

The tricyclene-9-butenone may be incorporated at any step in the production of the homogenized tobacco sheet, but it is preferably added after aging, curing and shredding and before the homogenized tobacco is formed into sheets. Likewise, it will be apparent that only a portion of the homogenized tobacco composition need be treated and the thus treated homogenized tobacco may be blended with other components before combining the homogenized tobacco with other tobaccos in order to produce therefrom cigarettes or other smoking articles. In such cases, the homogenized tobacco composition treated may have the tricyclene-9-butenone in excess of the amounts above-indicated so that when blended with other components and then with other tobaccos, the final product will have the percentage within the indicated range.

In accordance with one specific embodiment of this invention, a 50:50 (weight:weight) mixture of tobacco scraps and Virginia stems is sprayed with a one percent ethyl alcohol solution of tricyclene-9-butenone in an amount to provide a tobacco containing 400 ppm by weight of the tricyclene-9-butenone on a dry basis. Thereafter, the alcohol is removed by evaporation and 10% by weight of a 1:1:1 mixture of glycerine, carboxymethyl cellulose and diammomium phosphate, is added and the homogenized tobacco is manufactured into sheets by the usual techniques. The sheets are then admixed in a ratio of 15:85 (wt:wt) with Burley tobacco and the resulting mixture is formulated into cigarettes by the usual techniques. It has been found that the cigarettes when prepared as indicated have a desired and pleasing flavor, an aroma which to some people is described as "woody, sweet-floral and spicy" and is detectible and pleasing in the main and side smoke stream when the cigarette is smoked. The tricyclene-9-butenone of this invention may be applied to the particles of homogenized tobacco or to the homogenized tobacco sheet by spraying, dipping, or otherwise, utilizing suitable suspensions or solutions of the tricyclene-9-butenone. Thus, water or volatile organic solvents, such as alcohol, ether, acetone, volatile hydrocarbons and the like, may be used as the carrying medium for the tricyclene-9-butenone while it is being applied to the homogenized tobacco or homogenized tobacco sheet. Also, other flavor and aroma producing additives, such as:

a. Esters, for example:
Ethyl butyrate;
Ethyl acetate;
Ethyl valerate;
Amyl acetate;
Phenyl ethyl isovalerate; and
Methyl heptynyl carbonate
b. Aldehydes, for example:
3-phenyl-2-pentenal;
3-phenyl-3-pentenal;
Phenyl acetaldehyde;
Cinnamaldehyde; and
Beta-ethyl-cinnamaldehyde
c. Ketones, for example:
Benzylidene acetone;
Acetophenone;
Maltol; and
Ethyl maltol
d. Acetals, for example:
3-phenyl-4-pentenal dimethyl acetal; and
3-phenyl-4-pentenal diethyl acetal (described in copending application for U.S. Pat. No. 276,922 filed on Aug. 1, 1972)
e. Natural oils and extracts, for example:
Vanilla;
Coffee extract;
Origanum oil;
cocoa extract;
Oil of cloves;
Nutmeg oil;
Celery seed oil;
Bergamot oil; and
Ylang-ylang oil
f. Lactones, for example:
Delta-decalactone;
Delta-undecalactone;
Delta-dodecalactone;
Gamma-undecalactone; and
Coumarin
g. Ethers, for example:
Dibenzyl ether;
Vanillin; and
Eugenol
h. Pyrazines; for example:

2-Acetyl pyrazine;
2-Acetyl-6-methyl pyrazine;
2-Ethyl pyrazine;
2,3-Dimethyl pyrazine;
2,5-Dimethyl pyrazine; and
2-Ethyl-5-methyl pyrazine i. Pyrroles, for example:
N-cyclopropyl pyrrole; and
N-cyclooctyl pyrrole
j. Pyrones, for example:
6-n-propyl-alpha-pyrone
6-n-butyl-alpha-pyrone
6-i-butyl-alpha-pyrone
6-n-propyl-alpha-pyrone as well as those additives disclosed in U.S. Pat. Nos. 2,766,145; 2,905,575; 2,905,576; 2,978,365; 3,041,211; 2,766,149; 2,766,150; 3,589,372; 3,288,146; 3,402,051 and 3,380,457 as well as Australian Pat. No. 444,545; 444,507 and 444,389 may be incorporated into the homogenized tobacco sheet and/or the ultimate tobacco mixture with the tricyclene-9-butenone of this invention.

While this invention is principally useful in the manufacture of cigarette tobacco, it is also suitable for use in connection with the manufacture of pipe tobacco, cigars or other tobacco products. Furthermore, the homogenized tobacco containing the tricyclene-9-butenone may be added to certain tobacco substitutes of natural or synthetic origin and by the term "tobacco" as used throughout this specification is meant any composition intended for human consumption by smoking or otherwise, whether composed of tobacco plant parts or substitute materials or both (e.g., dried lettuce leaves and cabbage leaves).

Also, the invention has been particularly described with reference to the addition of the compounds directly to homogenized tobacco. However, it will be apparent that the compound may also be applied to the paper of the cigarette or to the wrapper of a cigar in addition to being applied to the homogenized tobacco itself. Also, it may be incorporated into the filter tip, the packaging material or the seam paste employed for gluing the cigarette paper. Thus, a tobacco product is provided which includes tricyclene-9-butenone homogenized tobacco and tobacco.

The following examples are given to illustrate the embodiments of the invention as it is presently preferred to practice it. It will be understood that these examples are illustrative and the invention is not to be considered as restricted thereto except as indicated in the appended claims.

BRIEF DESCRIPTION OF THE DRAWINGS

FIGS. 1 and 2 represent the NMR spectrum and IR spectrum respectively of 1, 7-dimethyl-7 (1-pent-2-en-4-onyl) nortricyclene.

EXAMPLE I

PREPARATION OF TRICYCLENE-9-BUTENONE

A. Preparation of π-Cyanotricyclene

Reaction:

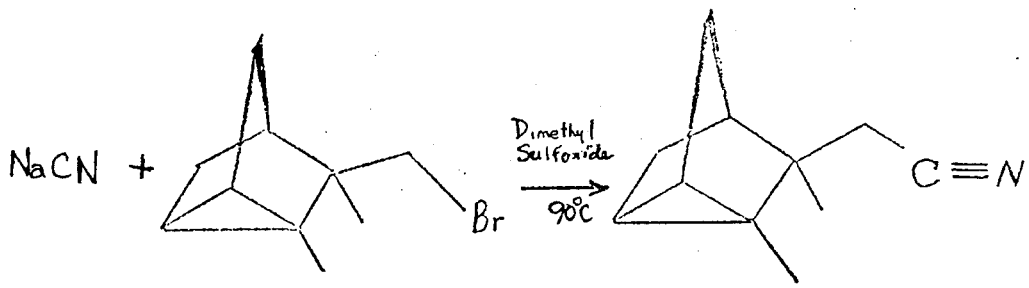

Into a 500 ml 3-neck, round bottom flask equipped with condenser, thermometer, mechanical stirrer, hot water heating bath and $N_2$ purge is charged 200 cc distilled dimethyl sulfoxide. 21.6 g (0.1 moles) of (−)-π-bromotricyclene is then added into the 500 ml flask containing the 200 ml of dimethyl sulfoxide. While stirring and purging with nitrogen, 77.6 g (1.58 moles) of sodium cyanide is then added. Heating by means of the hot water bath to 90°C is then effected and the 90°C temperature is maintained for 22 hours. The reaction mass is then cooled to 40°C (below which temperature it becomes solidified) and 200 ml of water is added thereto. The aqueous phase is then extracted with five 100 ml portions of petroleum ether. The combined petroleum ether extracts are then washed with three 50 ml portions of saturated sodium chloride solution and dried over anhydrous $MgSO_4$. The dried extract is filtered and the solvents are evaporated yielding 21.2 g of crude product.

The crude product is distilled on a 2 inches rushover column and collected three fractions. While distilling the condenser has to be heated as the pure nitrile solidifies.

Distillation Data:

| Fraction No. | Vapor Temp. | Liquid Temp. | Weight of Fraction | Pressure |
|---|---|---|---|---|
| 1 | 30–52°C | 60–65°C | 0.1 g | 0.15 mm Hg |
| 2 | 55 | 70 | 1.7 | 0.15 |
| 3 | 70 | 90 | 9.0 | 0.10 |

NMR, mass spectral and IR analysis confirm that fractions 1 and 2 consist essentially of π-cyanotricyclene having the structure:

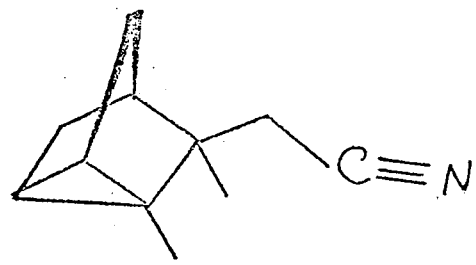

Mass spectral analysis in order of decreasing intensity:

m/e = 93, 121, 39, 27, 41.

B. Preparation of Nortracycloekasantalal

Reaction:

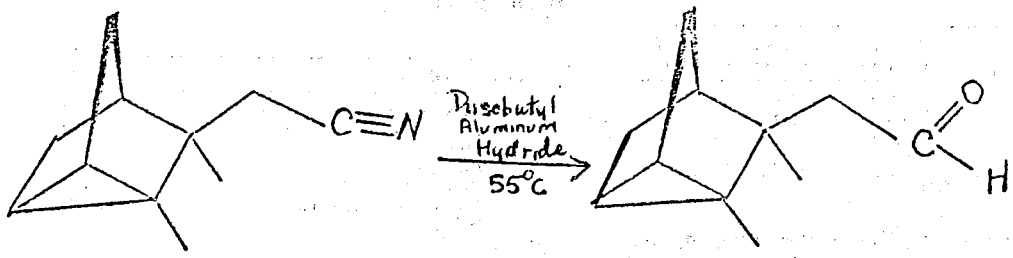

Into a 250 ml 3-neck, round bottom flask equipped with thermometer, condenser, mechanical stirrer, heating mantle, cooling bath (and mantle) and dropping funnel containing 75 ml hexane is charged 9 g (0.055 moles) of π-cyanotricyclene having the structure:

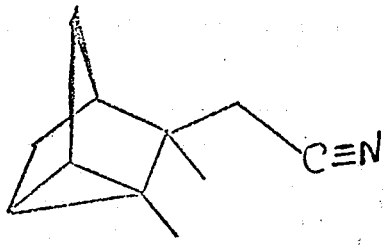

prepared according to Example I. While stirring and purging with $N_2$ slowly added 45 g (0.06 moles) diisobutyl aluminum hydride ("Dibal-H") (20% in hexane) over a period of ½ hours. The reaction temperature rises to 20°C and is heated to 55°C and maintained at that temperature for four hours. The reaction mixture is cooled to 5°C and 60 g of diethyl ether containing 0.5 ml of water is added slowly, followed by addition of 75 ml of 10% sulfuric acid. The upper organic phase is separated and washed with 15 ml of $NaHCO_3$ solution (saturated) and then with three 20 ml portions of saturated NaCl solution. The organic phase is then dried over anhydrous $MgSO_4$ and filtered. The solvent evaporated, yielding 16.2 g of crude aldehyde which is distilled on a 2 inches "rush-over" column and collected in four fractions. (Yield = 99.5%).

| Fraction No. | Liquid Temperature | Vapor Temperature | Pressure (mm Hg) | Weight of Fraction |
|---|---|---|---|---|
| 1 | 45–48°C | 30–35°C | 0.30 | 0.6 g |
| 2 | 51 | 43 | 0.20 | 3.3 |
| 3 | 65 | 41 | 0.15 | 4.6 |
| 4 | 85 | 46 | 0.15 | 0.8 |

NMR, mass spectral and IR analyses confirm that fractions 2 and 3 consist essentially of nortricycloekasantalal having the structure:

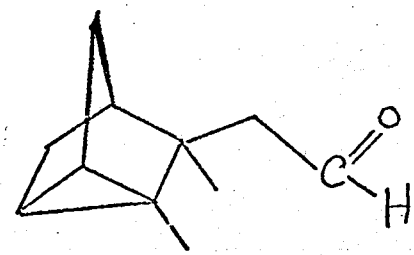

Mass spectral analysis (in order of decreasing intensity):

m/e = 93/91, 105, 79, 120.

C. Preparation of Tracyclene-9-butenone (1,7-Dimethyl-7-(1-pent-2-en-4-onyl Nortricyclene)

Reaction:

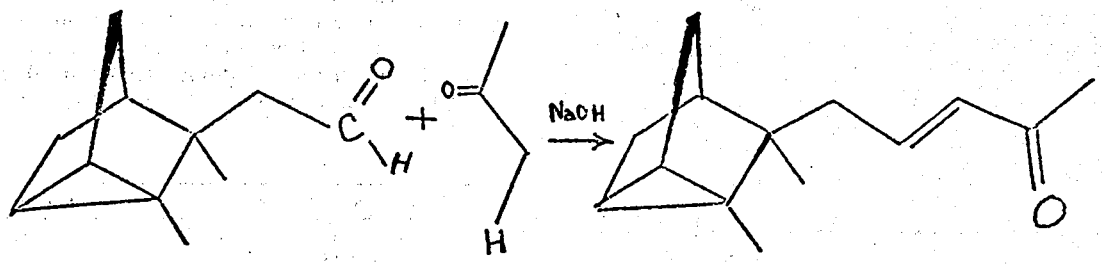

Into a 100 ml, 3-neck round bottom flask equipped with magnetic stirrer, thermometer and a heating mantle is placed 6 g (0.037 moles) of nortricycloekasantalal produced according to the process of Example II. A cold solution of 12.0 g (0.23 moles) of acetone containing 1.2 g of NaOH and 3 ml of water is then added to the nortricycloekasantalal. The reaction mass is heated to 35°C and maintained at that temperature for 7 hours. The mass is then cooled and neutralized with 25 ml of aqueous HCl. The solvents are evaporated using a "roto vap" at about 70°C. The salts are then dissolved with water and the aqueous phase is extracted with five 30 ml portions of diethyl ether. The resulting ethereal solution is washed with three 20 ml portions of saturated NaCl solution, dried over anhydrous $MgSO_4$ and filtered. The solvents are evaporated yielding 7.2 g of crude product. The crude product is distilled on a 2 inches "rush-over" column (yield: 80%) yielding the following fractions:

| Fraction No. | Liquid Temperature | Vapor Temperature | Pressure (mm Hg) | Weight of Fraction |
|---|---|---|---|---|
| 1 | 60–116°C | 25–85°C | 0.2–0.3 | — |
| 2 | 119 | 93 | 0.2 | 1.2 g |
| 3 | 140 | 96 | 0.2 | 2.9 |
| 4 | 180 | 105 | 0.2 | 0.7 |

NMR, mass spectral and IR analyses confirm that fractions 2-4 consist essentially of 1,7-dimethyl-7 (1-pent-2-en-4-onyl) nortricyclene having the structure:

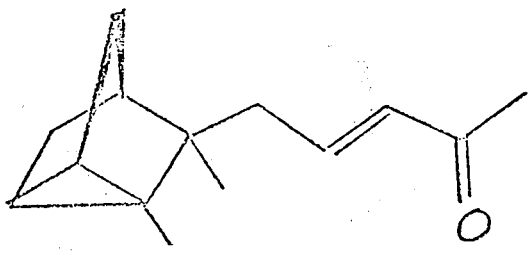

Analyses:

1. Mass spectral analysis (in order of decreasing intensity): m/e = 121, 93, 43, 79, 91, 41.
2. The NMR spectrum is illustrated in FIG. 1.
3. The IR spectrum is illustrated in FIG. 2.
4. The NMR analysis is as follows:

| Peak | | Interpretation |
|---|---|---|
| 0.86 ppm | (s) | $CH_3—C—$ |
| 1.06 | (s) | $CH_3—C—$ |
| 1.72–0.92 | | methylene and methine protons |
| 2.10 | (d) | $CH_2—C{=}C—\overset{O}{\overset{\|\|}{C}}$ |
| 2.28 | (s) | $CH_3—\overset{O}{\overset{\|\|}{C}}—$ |
| 6.08 | | $—C{=}C—\overset{O}{\overset{\|\|}{C}}$ |
| 6.95–6.6 | | $—\underset{H}{C}{=}\underset{H}{C}—\overset{O}{\overset{\|\|}{C}}$ |

5. The infrared analysis is as follows:

855 $cm^{-1}$
985
1088
1160
1190
1260
1370
1440
1460
1640
1675
2850
2950

EXAMPLE II

TOBACCO USE OF TRICYCLENE-9-BUTENONE

The following tobacco flavor formulations (A) and (B) are prepared:

| (A) Ingredients | Parts |
|---|---|
| Ethyl butyrate | 0.05 |
| Ethyl valerate | 0.05 |
| Maltol | 2.00 |
| Cocoa extract | 26.00 |
| Coffee extract | 10.00 |
| Ethanol (95% aqueous) | 20.00 |
| Water | 41.90 |

| (B) Ingredients | Parts |
|---|---|
| Ethyl butyrate | 0.05 |
| Ethyl valerate | 0.05 |
| Maltol | 2.00 |
| Cocoa extract | 26.00 |
| Coffee extract | 10.00 |
| Ethanol (95% aqueous) | 20.00 |
| Water | 41.90 |
| Tricyclene-9-butenone | 25.00 |

A homogenized tobacco formulation (C) is prepared as follows:

| Ingredients | Parts |
|---|---|
| Tobacco Scrap | 100 |
| Burley Tobacco Stems | 33.3 |
| Virginia Tobacco Stems | 66.7 |
| Carboxymethyl cellulose | 2.0 |
| Diammonium phosphate | 15.0 |
| Glycerine | 12.0 |
| Water | 3600 |

The flavor formulations (A) and (B) are each added to individual portions of the homogenized tobacco formulation (C) at the rate of 0.1% by weight of the homogenized tobacco. The flavored and non-flavored homogenized tobacco formulations (containing (i) A, (ii) B and (iii) no additional flavor) are then admixed with the following tobacco mixture (D) in the ratio C:D of 15:85:

| (D) Ingredient | Parts by Weight |
|---|---|
| Bright tobacco | 40.1 |
| Burley tobacco | 24.9 |
| Maryland tobacco | 1.1 |
| Turkish tobacco | 11.6 |
| Stem (flue-cured) tobacco | 14.2 |
| Glycerine | 2.8 |
| Water | 5.3 |

Each of mixtures (i), (ii) and (iii) are then formulated into cigarettes.

The use of the tricyclene-9-butenone in the cigarettes causes the cigarettes prior to smoking to have a sweet, floral, spicy-sandalwood, green aroma. On smoking the cigarettes containing the tricyclene-9-butenone are found relative to those cigarettes not containing tricyclene-9-butenone to be richer, sweeter and spicier and to have floral and woody notes whereas cigarettes not containing tricyclene-9-butenone do not have these notes.

It will be understood by those skilled in the art from the foregoing description that that alphapyrones of our invention can be used in the preparation of a wide variety of homogenized tobacco flavors and tobacco products containing same.

What is claimed is:

1. A process for altering the organoleptic properties of tobacco comprising the step of adding to tobacco, homogenized tobacco containing a flavoring composition comprising tricyclene-9-butenone having the structure:

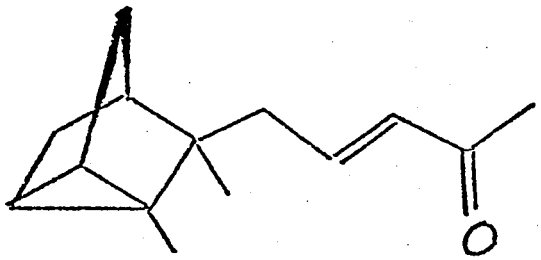

and at least one tobacco flavoring additive selected from the group consisting of:

Esters;
Pyrones;
Aldehydes;
Ketones;
Acetals;
Natural oils and extracts;
Lactones;
Ethers;
Pyrazines; and
Pyrroles The amount of said tricyclene-9-butenone in said combined tobacco and homogenized tobacco being from 100 up to 5000 parts per million based on the combined weight of said homogenized tobacco and said tobacco.

2. A tobacco article comprising homogenized tobacco, tobacco and tricyclene-9-butenone, said tricyclene-9-butenone being present in an amount of from 100 up to 5000 parts per million based on the combined weight of said homogenized tobacco and said tobacco.

3. The tobacco articles of claim 2 wherein the ratio of homogenized tobacco to tobacco is about 85:15 and the concentration of tricyclene-9-butenone in said tobacco article is in the range of 150–400 ppm.

* * * * *